US009198547B2

(12) United States Patent
Ondaatje et al.

(10) Patent No.: US 9,198,547 B2
(45) Date of Patent: Dec. 1, 2015

(54) PORTABLE AND ADJUSTABLE CHILD POTTY

(75) Inventors: Donald Erwin Ondaatje, Charlottetown (CA); Chaminda Basnayake, Windsor (CA); Sherzade Laru Ondaatje-Khan, Aurora (CA); Sherani Manoranjani Jayawickrama, Charlottetown (CA)

(73) Assignee: Chaminda Basnayake, Windsor (CA)

( * ) Notice: Subject to any disclaimer, the term of this patent is extended or adjusted under 35 U.S.C. 154(b) by 113 days.

(21) Appl. No.: 13/502,138

(22) PCT Filed: Jul. 4, 2011

(86) PCT No.: PCT/CA2011/050410

§ 371 (c)(1), (2), (4) Date: Apr. 15, 2012

(87) PCT Pub. No.: WO2012/088599

PCT Pub. Date: Jul. 5, 2012

(65) Prior Publication Data

US 2013/0198946 A1 Aug. 8, 2013

Related U.S. Application Data

(60) Provisional application No. 61/428,584, filed on Dec. 30, 2010.

(51) Int. Cl.
*A47K 11/04* (2006.01)
*A47K 13/06* (2006.01)

(52) U.S. Cl.
CPC ..... *A47K 11/04* (2013.01); *A47K 13/06* (2013.01)

(58) Field of Classification Search
CPC ..... A47D 1/008; A47C 7/70; A47K 11/04; A47K 13/06
USPC ..... 4/902, 483; 403/109.8; 297/440.24
See application file for complete search history.

(56) References Cited

U.S. PATENT DOCUMENTS

| | | | | |
|---|---|---|---|---|
| 3,148,914 | A * | 9/1964 | Steely | 297/149 |
| 3,416,163 | A * | 12/1968 | Jordan | 4/483 |
| 4,946,180 | A * | 8/1990 | Baer | 280/39 |
| 5,123,126 | A * | 6/1992 | Vincent | 4/480 |
| 6,698,830 | B1 * | 3/2004 | Gaines | 297/188.11 |
| 7,506,923 | B1 * | 3/2009 | Gauss | 297/150 |

(Continued)

*Primary Examiner* — Janie Christiansen
(74) *Attorney, Agent, or Firm* — Greer, Burns & Crain, Ltd.

(57) ABSTRACT

A portable and adjustable child potty is invented and described. The invention provides the perfect combination of utility, efficiency, and hygiene. The device can be adjusted to suit users of different ages and body sizes in terms of its height, width, and length. The invented device can be packaged to a Travel Size such that it takes very little space for transportation. Size adjustment and Travel size to usage size changes can be done using a series of easily adjustable locks that can be operated by hand without the use of particular tools. The device is constructed using pipes such that a length of each arm can be adjusted by moving parts of the arms with respect to each other and locking them at a preferred setting. The potty seat can also be folded and contracted to a Travel Size. The device uses a biodegradable and disposable bag to collect the waste. A particular embodiment of the device may include height adjustable arm rests and a back rest. The device may also be used with an optional activity surface. While adult supervision of the use is always required, the anti-roll base and pelvic belt provide additional stability for the use with young children.

10 Claims, 14 Drawing Sheets

(56) References Cited

U.S. PATENT DOCUMENTS 7,891,030 B1 * 2/2011 Sutton ..... 4/483
2009/0255044 A1 * 10/2009 Pokorski ..... 4/483
2010/0243011 A1 * 9/2010 Lin ..... 135/66

* cited by examiner

PORTABLE AND ADJUSTABLE CHILD POTTY

TECHNICAL FIELD

The invention generally relates to the field of child potty used for potty training and for general use for children. The invention is also related to the field of portable potty that can be used by children as well as by adults.

BACKGROUND ART

A potty is an essential part in a child's care device set, among other devices such as car seats, strollers, and toys. From the time children are potty trained a child uses a potty until they are able to use a standard toilet often with the use of a modified child seat for children. It is common for a child to develop a preference towards using a particular potty (i.e., of favorite color or one with the favorite cartoon character) at a particular age. Therefore a potty can become a part of the child care kit that travels with the child when traveling just like a car seat or a collapsible stroller.

Portable potty is a useful tool for adults and children, particularly while traveling. As an example, one could carry a portable potty for outdoor activities such as camping for the use of adults. With appropriate privacy attachments, a portable potty can be a very hygienic and desirable option when standard facilities are not available or limited, for example in areas such as parks or camping grounds.

Prior art includes various portable potty inventions which have major size and adjustability disadvantages compared to the invented Portable and Adjustable Child Potty.

DISCLOSURE OF INVENTION

Technical Problem

The bulky size of existing potty products is a major difficulty with the devices in the market at present. When a potty needs to be transported from a place to another, a fixed and large space is taken up by the device. For instance, for a family with two children, a 1 year old and a 3 year old as an example, two devices may need to be transported and each takes a fixed space and adds weight. If the travel involves air travel or outdoor, having to carry an extra volume of cargo and extra weight is a problem.

Second issue with the current potty products is their fixed size. As a child grows up, their height, body size, and weight change rapidly compared to an adult. As a result, multiple devices are needed to support the child at different ages. Typically, a smaller size is needed when the child is potty training and as they reach a certain age, the smaller device becomes unusable. It is not uncommon to see a parent buying 3-4 potty of different sizes or standard toilet attachments of different sizes as a child grows up.

Technical Solution

The invention addresses technical problems associated with existing potty, namely the difficulty to transport due to their size and their inability to change size according to the user needs.

The invented device consists of two main components that are required for its use. These are the Adjustable Potty Chair Frame and the Potty Seat. The device may be used with two other optional components for added safety and functionality. These are the Pelvic Belt that can be used to fasten a child to the seat and the Activity Surface that can be used as a drawing board or a support for reading or any other activity.

The device has an Adjustable Potty Chair Frame that is designed such that its height, width, and length (H, W, and L) can be adjusted. As an example, the H can be adjusted to 6", 10", or 12". The W can be adjusted to 8"×8" or 12"×12". The length can be adjusted to any setting in the W range as well. All of these adjustments can be made independent of the adjustments of the other two dimensions. For storage or travel, the frame can be retracted to a Travel Size of approximately 6"×6"×6" in H, W, and Las an example in one embodiment of the invention.

Each member of the Adjustable Potty Chair Frame is made out of hollow tubing of a particular shape such that a part of a member can collapse into a larger part of a member or expand out of a larger part of a member when the size is adjusted. The tubes may be made of Aluminum or similar lightweight material as an example. The locks and corner joints may be manufactured with a material combination such as metal and plastic.

The Potty Seat is designed such that its sides can retract to make the part a smaller size for storage and transportation. According to the teachings of this invention, the seat can be also modified such that it can be folded in half along its length. When in use with the Adjustable Potty Chair Frame, the seat is set on the Adjustable Potty Chair Frame and the sides are fixed to the edge arms of the Adjustable Potty Chair Frame. The Potty Seat also has one or more retractable arms in the back and front that attach onto the back and front arms of the Adjustable Potty Chair Frame. To make it to Travel Size, the side flaps can be collapsed into the space under the Potty Seat ring. The seat may be modified such that a smaller flap retracts into a larger flap and then both of them can be retracted under the seat ring.

The invented Child Potty is designed with an optional Pelvic Belt can be attached to the Adjustable Potty Chair Frame such that a child can be fastened to the device in the seated position for safety purposes. In one embodiment of the invention, the belt is secured to three points in the Adjustable Potty Chair Frame, to the left and right back corners and the center point of the front arm. The belt can be opened at the center connector to place the child on the seat.

The invented Child Potty can further include an optional Activity Surface that can be attached to the armrests of the Adjustable Potty Chair Frame such that a child may use it as a drawing board or a support for reading or any other activity. This attachment is also made such that it can be packaged to a smaller size by means of retracting one side into the other or by folding or by a combination of both. The underside of the surface is constructed with web-like construction so that the load on it is distributed to the chair armrests with minimal or no sagging of the top surface. It is noted that this surface can also be constructed as a foldable component similar to the Potty Seat construction.

Advantageous Effect

The invention enables parents to use a single potty for a child as the child grows up and offers great flexibility in home use as well as use while traveling. As the seat height, width, and length can be adjusted, the device can be used for a child as the child grows up. Initially, it can be used at the lowest height (H) setting of 6" and the width and length (W & L) size of 10"×10" for infant or older infant/young toddler potty training. As the child grows the height can be adjusted, for instance to 10" H for older toddlers and 12" H at even older ages such as 3-6 years etc. The W & L sizes can be increased as required over this growth period to 12"×12" from the previous setting, so age and weight are not specifically attached to this potty.

In case of using the invented device with multiple children, the device can be used with children of multiple ages by adjusting W, L, and H settings between uses by the children of different ages. For instance, if the device is to be shared between a 1 year old and a 3 year old, W & L could be set to 10"×10" for both of them and the H adjustment can be changed between 6" and 10" for the younger and the older respectively.

The device may be used for a whole family during travel and/or outdoor activities such as camping. As in the case of multiple children, the device dimensions need to be adjusted between the users and the bags be replaced. As the device can be packaged to the Travel Size, it makes it very convenient for transportation. For instance, for a camping excursion, only one small sized device need to be carried for the needs of the whole family. Because of the anti-roll and sturdy construction of the device base, it can be used even on loose soil (i.e., sandy soil or grass).

DESCRIPTION OF DRAWINGS

FIG. 3A shows the full arm assembly with two individually lockable locks. FIG. 3B shows the cross sections of the individual locks in the "locked" position.

FIG. 3C shows cross sections of the locks in "unlocked" position.

Shown in FIG. 6A is one embodiment of the Potty Seat with adjustable extensions in all sides.

DETAILED DESCRIPTION OF THE DRAWING

Figure 1:
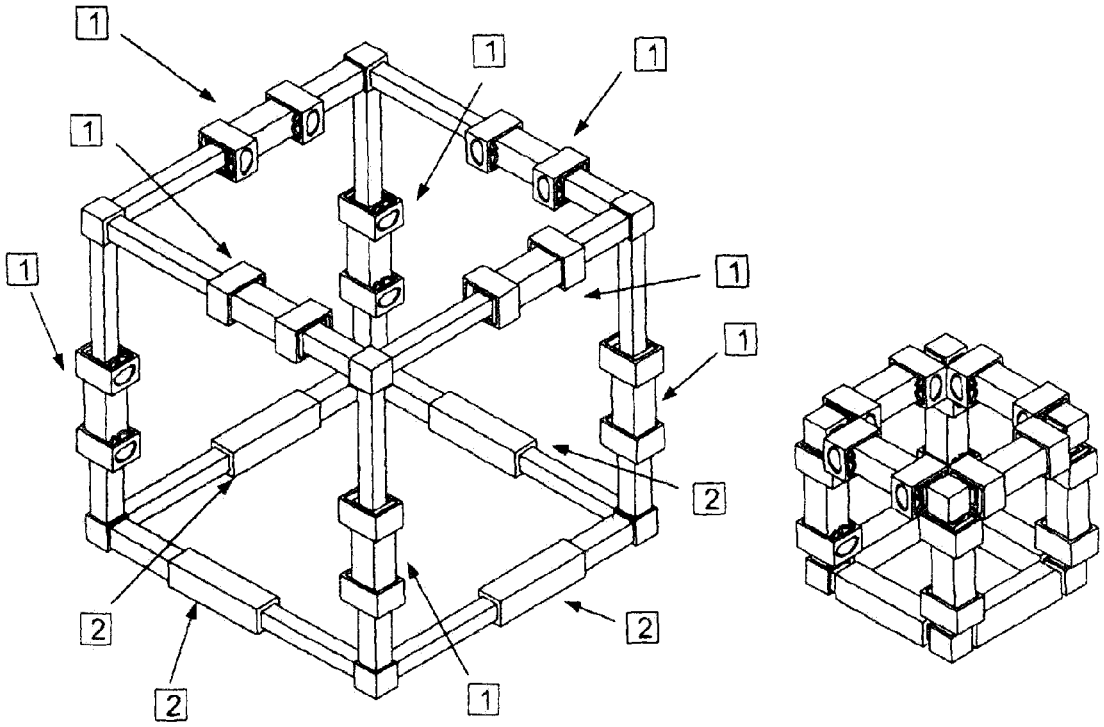
FIG. 1 shows the Adjustable Potty Chair Frame in its maximum size setting (Left) and the Adjustable Potty Chair Frame in its smallest size which is also the Travel Size (Right).

FIG. 1 shows the Adjustable Potty Chair Frame in its maximum size setting (Left) and the Adjustable Potty Chair Frame in its smallest size which is also the Travel Size. At the maximum size of the particular embodiment shown, the frame is setup at 12"×12"×12" H, W, and L (Height, Width, and Length). At the minimum Travel Size, the same frame set to the size of 6"×6"×6". The embodiment shown in FIG. 1 shows 8 independent locks marked as 1 that can be used to secure the device at a particular setting. Four locks indicated as 1 that are attached to the vertical members are used to set the height (H) of the device, two locks marked as 1 and are located in the horizontal arms (parallel arms) of the top surface of the frame are used for length (L) setting, and the other two locks 1 that in parallel arms and the top surface of the frame are used for the width (W) setting. Each of the locks 1 can be operated by a single hand and both sides of the locks 1 can be operated independently. It is understood that number of locks and their placement can be modified to reduce the number of locks or by making some members fixed/non-adjustable. Push-to-Release type locks are used in this embodiment. A lock can be released by pushing a designated part of the lock and with a released lock, one arm tube can be moved with respect to the other tube connected to the lock. It is noted that this particular lock type is used for illustration purposes only and other locking mechanisms may be used to achieve the same objective as these. The embodiment shown in FIG. 1 has arms that contain no locks in the bottom layer. Instead the arms in the bottom layer of the frame have the largest size of the tube without locks indicated as 2. This enables the frame length and width settings to be changed with only the locks 1 located in the top surface of the frame.

Figure 2:
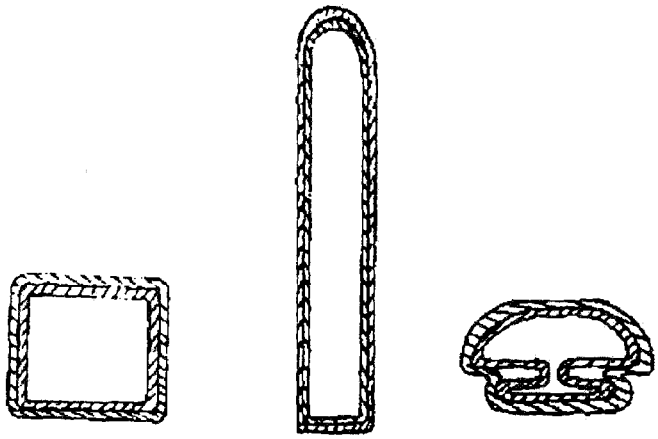
FIG. 2 shows some example Adjustable Potty Chair Frame arm/member cross sections.

Adjustable Potty Chair Frame can be made out of tubing of different shapes and sizes. An example set of cross sections are given in FIG. 2. It is noted that other sizes, shapes, thicknesses and such variations may be used for the same functionality without departing from the teachings of this invention.

Figure 3A:
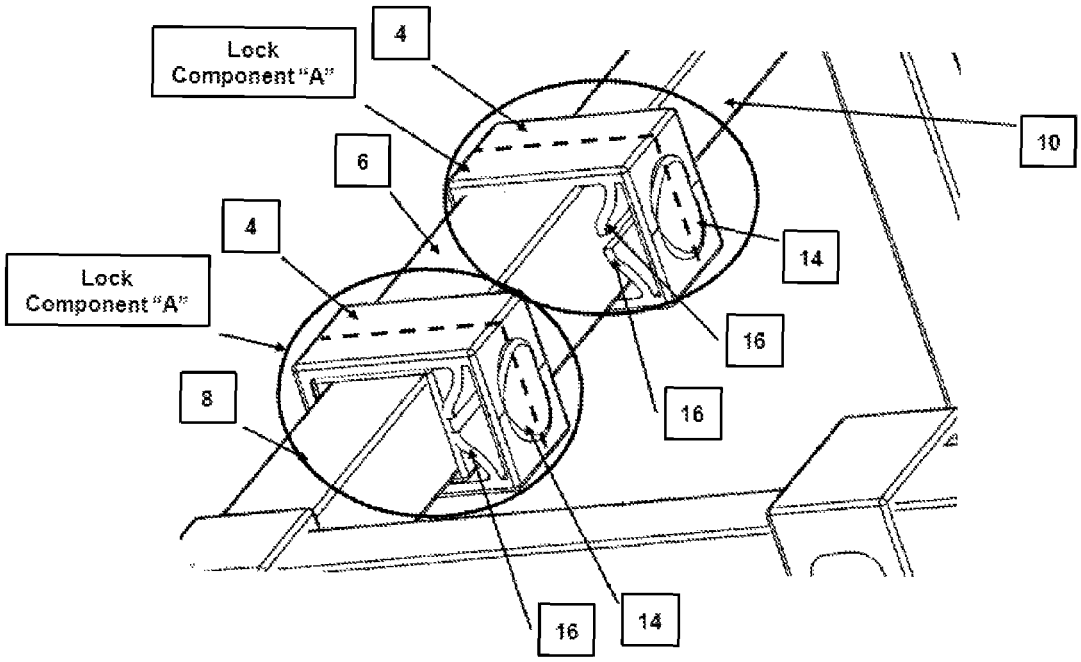
FIGS. 3A, 3B, and 3C illustrate the functionality of the Push-to-Release locking method used in a particular embodiment of the invention.
Figure 3B:
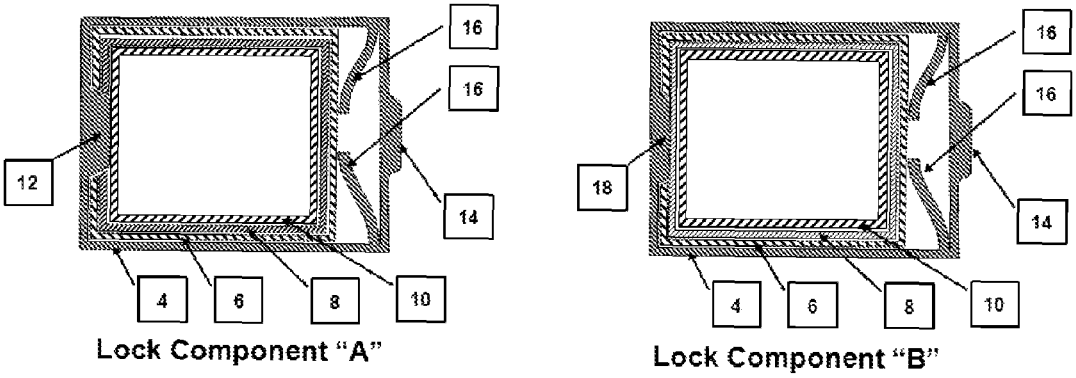
Figure 3C:
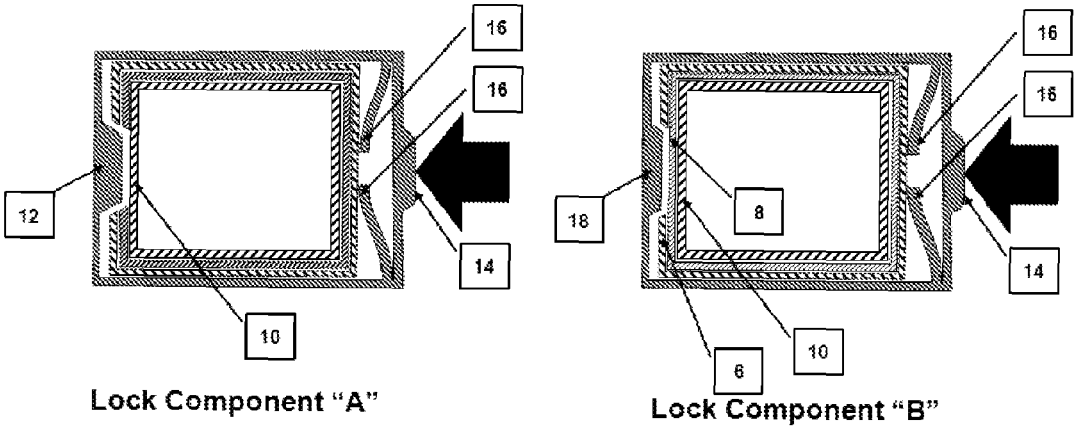

FIGS. 3A, 3B, and 3C illustrate the functionality of the Push-to-Release locking method used in a particular embodiment of the invention. FIG. 3A shows the full arm assembly with one lock indicated as 1 in FIG. 1. This lock contains two individually lockable lock components identified as 4. Two independent lock components 4 are mounted onto the ends of the largest fixed length arm member identified as 6. Arm members 8 and 10 are designed such that they are smaller in cross section compared to arm member 6. Arm member cross sections are designed such that member 10 is able to slide inside member 8 and member 8 in turn can slide inside member 6. For locking mechanism illustration purposes, two independent lock components 4 are identified as Lock Component "A" and Lock Component "B" in FIG. 3A. The independent lock component 4 has an outside surface part/knob 14 and a part 16 that presses against the largest fixed length arm member 6. Part 16 is designed such that its open ends can deform when pushed against arm member 6. Pressing on surface part/knob 14 enables the independent lock components 4 to move with respect to the arm member 6 along a perpendicular direction to the length of the arm member 6. FIG. 3B shows the cross sections of the independent lock components 4 in the "locked" position. In Lock Component "A", component 16 is pressing against arm member 6 such that a protruding part 12 is pressed against the inner most arm member 10. Other arm members 6 and 8 have openings to accommodate the motion of the protruding part 12 along the plane shown in FIG. 3B. In Lock Component "B", component 16 is pressing against arm member 6 such that a protruding part 18 is pressed against the arm member 8. Only the arm member 6 has an opening to accommodate the motion of the protruding part 18 along the plane shown in FIG. 3B. In the setting shown in FIG. 3B, arm members 10, 8, and 6 are in fixed positions with respect to each other as arm members 8 and 10 are held in fixed positions with respect to arm member 6 by protruding parts 12 and 18. FIG. 3C shows cross sections of the independent lock components 4 in "unlocked" position. To release Lock Component "A", a user needs to push surface part/knob 14 in the direction shown with the black arrow with respect to the arm member 6. This moves the protruding part 12 away from arm member 10 allowing it to be moved with respect to the arm member 6 which is also the direction perpendicular to the plane shown in FIG. 3C. Similarly to release Lock Component "B", a user needs to push surface part/knob 14 in the direction shown with the black arrow with respect to the arm member 6. This moves the protruding part 18 away from arm member 8 allowing it to be moved with respect to the arm member 6 which is also the direction perpendicular to the plane shown in FIG. 3C.

Figure 4A:
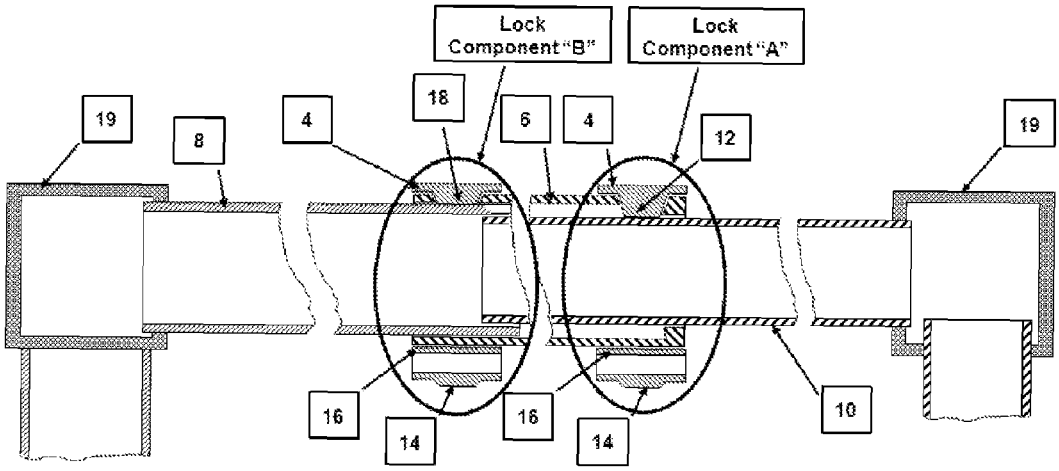
FIG. 4A shows how an arm of the Adjustable Potty Chair Frame is constructed using locks and tubes of different sizes at a length setting longer than the smallest size.
Figure 4B:
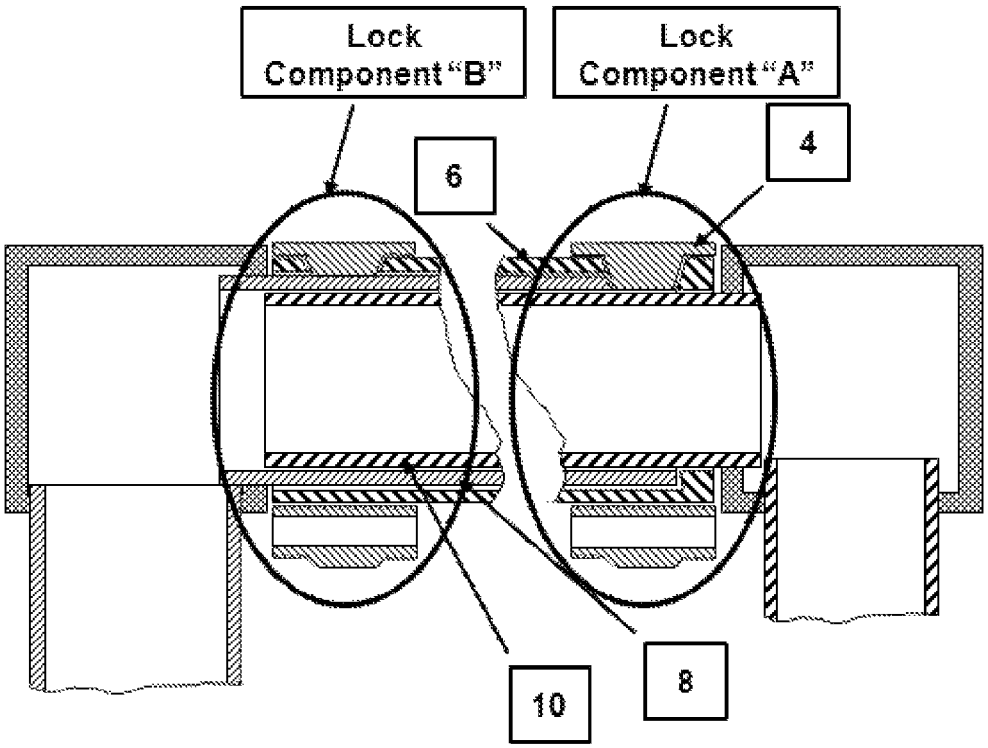
FIG. 4B shows how the arm can be set to its smallest size.

FIG. 4A shows how an arm of the Adjustable Potty Chair Frame is constructed using locks and arm members of different sizes at a length setting longer than the smallest size. In the given embodiment, a given Adjustable Potty Chair Frame arm member is constructed using arm members of three sizes. Arm member cross sections are designed such that member 10 is able to slide inside member 8 and member 8 in turn can slide inside member 6. The arm section with the Push-to-Release lock components 4 (marked as Lock Components "A" and "B" in FIG. 4A) identified as 6 has the largest cross section. At the setting shown in FIG. 4A, arm members 10, 8, and 6 are in fixed positions with respect to each other as arm members 8 and 10 are held in fixed positions with respect to arm member 6 by protruding parts 12 and 18. End fixtures 19 are used to join three arms to form an end connection and 8 of which form the full potty frame. FIG. 4B shows how the arm can be set to its smallest size. To bring an arm to this setting, a user unlocks one or both of the independent lock components 4 using the push action illustrated in FIG. 3C and pushes the smallest arm member 10 inside the arm member with the next size increment 8 and then push the member 8 inside the member 6. As illustrated in FIG. 4B, length of the arm member 6 is designed such that the full lengths of arm members 10 and 8 can be accommodated inside arm member 6 reducing the overall length of the arm to the smallest/Travel size.

Figure 5:
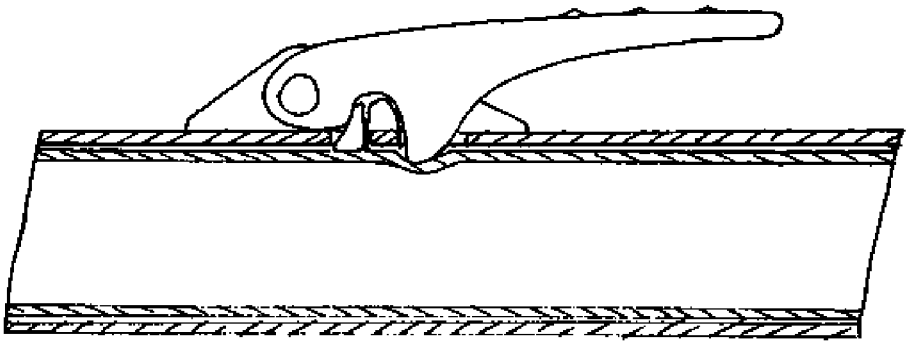
FIG. 5 shows an alternative Lift-to-Release lock that can be used instead of the Push-to-Release locking method.

FIG. 5 shows an alternative Lift-to-Release lock that can be used instead of the Push-to-Release locking method. These locks may perform the same function as the Push-to-Release locking method and enable the device to operate as another embodiment of this invention.

Figure 6A:
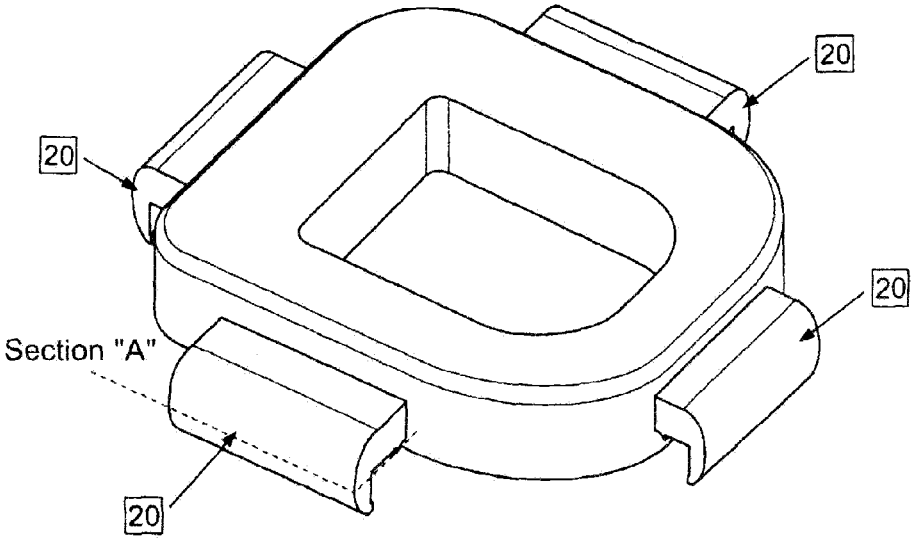
FIG. 6B shows how the Potty Seat with adjustable extensions is mounted onto an arm of the Potty Frame with the arm locks in the "Locked" position.
FIG. 6C shows how the adjustable extensions are fixed onto the Potty Frame arm when the device is in use.
FIG. 6D shows the user action required to remove the Potty Seat from the Potty Frame arm.
Figure 6B:
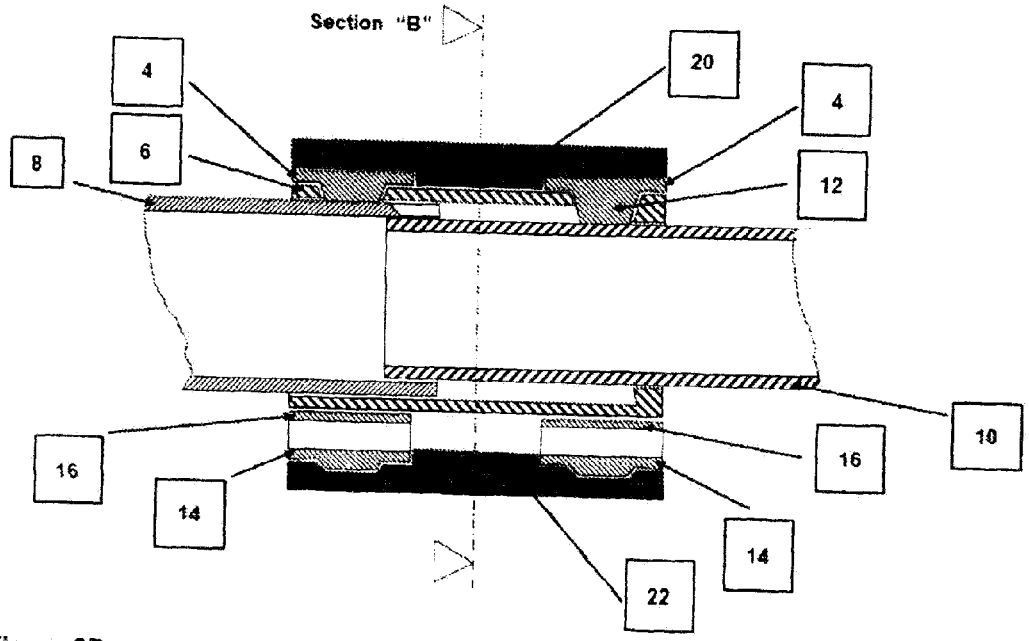
Figure 6C:
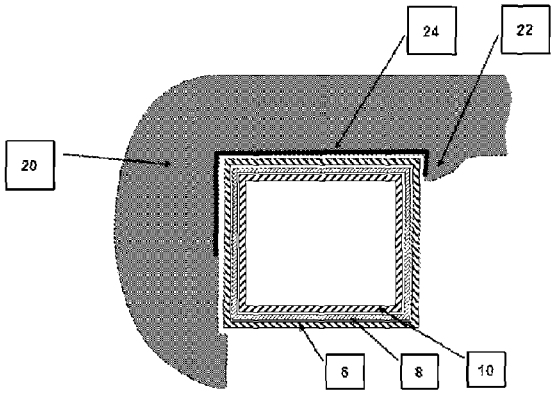
Figure 6D:
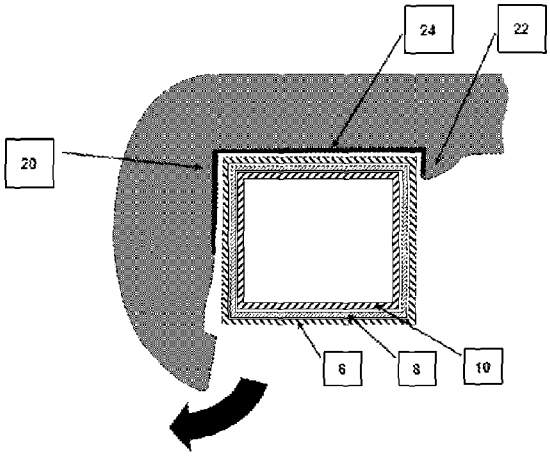

FIG. 6A is one embodiment of the Potty Seat with adjustable extensions in all sides. The adjustable extensions 20 can be pushed all the way in to set seat to its smallest size. The adjustable extensions 20 can be moved away by different distances from the seat so that the adjustable extensions 20 can be mounted on to the Potty Frame at different settings of the frame. FIG. 6B shows how the Potty Seat with adjustable extensions is mounted onto an arm of the Potty Frame with the arm locks in the "Locked" position using a cross section along Section "A" shown in FIG. 6A. In FIG. 6B, independent lock components 4 are in "locked" position holding arm members 6, 8, and 10 in fixed positions with respect to each other. Surface part/knob 14 and component 16 are shown at their locked positions. The adjustable extensions 20 include a ledge 22 that guides the adjustable extensions 20 onto the arm assembly. If a particular lock is in "unlocked" position, for instance independent lock components 4 mounted to the side of the arm member 10, the amount by which independent lock components 4 extends beyond the outer edge of the arm member 6 become larger than what is shown in FIG. 6B. Sides of the adjustable extensions 20 are designed such that adjustable extensions 20 will securely fit onto the arm assembly only if the amount by which independent lock components 4 extends beyond the outer edge of the arm member 6 is limited to the distance shown in FIG. 6B. FIG. 6C shows how the adjustable extensions are fixed onto the Potty Frame arm when the device is in use. The adjustable extensions 20 include a ledge 22 and a rigid sleeve 24 that is designed to accommodate the largest arm member 6. FIG. 6D shows the user action required to remove the Potty Seat from the Potty Frame arm. Lower part of adjustable extensions 20 beyond the rigid sleeve 24 is designed such that it can be deformed to an extent sufficient to clear the largest arm member 6. A user twists the lower outer edge of the adjustable extension 20 to clear the largest arm member 6 and may remove the adjustable extension 20 away from the frame arm member. In the Travel Size setting, all adjustable extensions can be pushed under the Potty Seat minimizing the size of the overall part. When used as a part of the Portable and Adjustable Potty, the Adjustable Potty Chair Frame is first set to a particular size and the adjustable extensions of the Potty Seat are extended such that the size adjusted Potty Seat fits onto the top of the Adjustable Potty Chair Frame.

Figure 7:
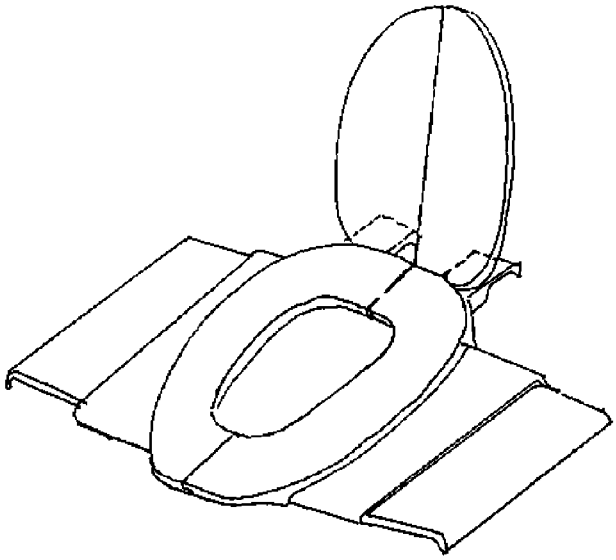
FIG. 7 is another embodiment of the Potty Seat with adjustable extensions in three sides, a Potty Seat lid, and a foldable Travel Size configuration.

FIG. 7 is another embodiment of the Potty Seat with adjustable extensions in three sides, a Potty Seat lid, and a foldable Travel Size configuration. In this configuration, wider adjustable extensions are located in the sides with another extendable part inside it. This enables the adjustable extensions to reach a wider width while not increasing the width of the Travel Size configuration. The back of this embodiment has two extendable arms, each similar to the adjustable extensions shown in FIG. 6. In the Travel Size configuration, adjustable extensions are pushed all the way inside the Potty Seat, the lid is closed, and the whole unit can be folded in half. The mounting of this embodiment of the Potty Seat is similar to that shown in FIG. 6.

Figure 8A:
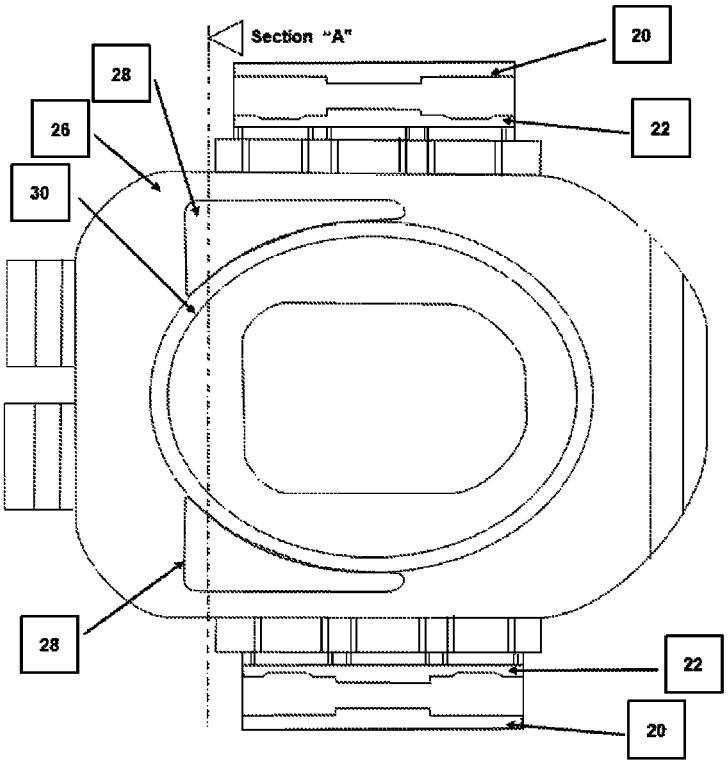
FIG. 8A shows a view of the underside of the Potty Seat with adjustable extensions in all sides and FIGS. 8B and 8C show two cross sections of the Potty Seat embodiment illustrating how the Disposable Waste Bag is attached to the Potty Seat.
Figure 8B:
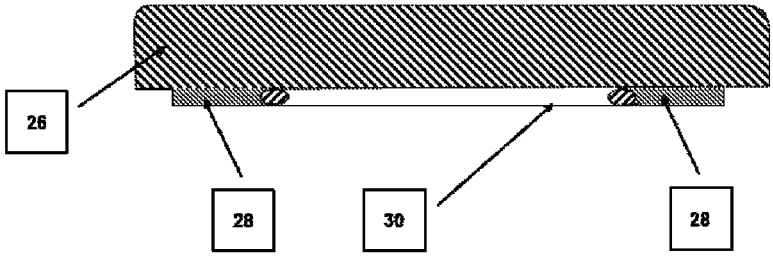
Figure 8C:
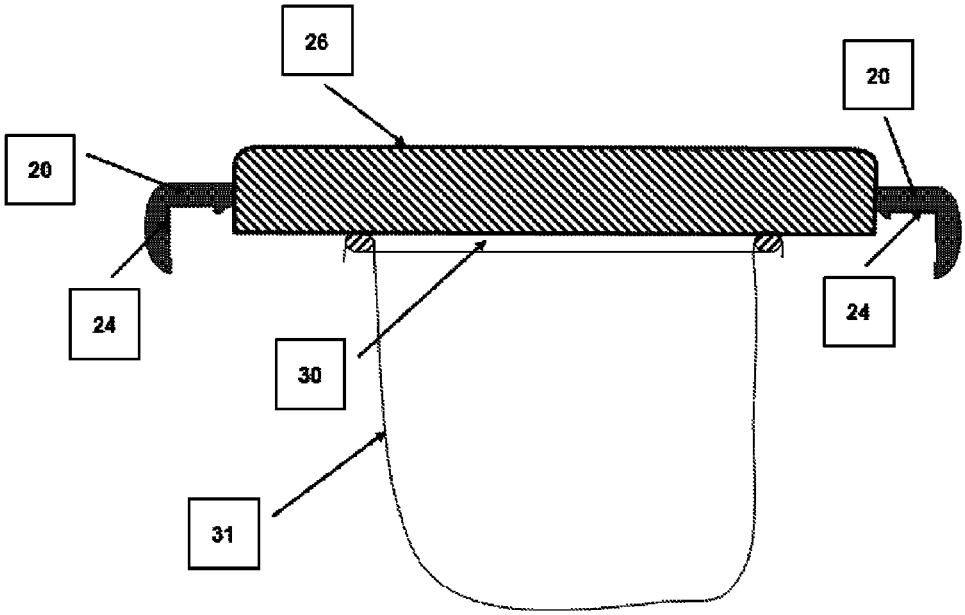

FIG. 8A shows a view of the underside of the Potty Seat with adjustable extensions in all sides. FIG. 8A shows the base of the Potty Seat 26, the adjustable extensions 20, ledge 22, potty waste bag holder ring 30, and two potty waste bag ring holder parts 28 built-in to the base of the Potty Seat 26. The functionality of potty waste bag holder ring 30 and two potty waste bag ring holder parts 28 is illustrated using cross section drawings A and B shown as FIGS. 8B and 8C. As shown in FIG. 8B, two potty waste bag ring holder parts 28 are designed such that they have an inner wall that receives the potty waste bag holder ring 30. Two potty waste bag ring holder parts 28 are also designed such that the potty waste bag holder ring 30 can be forced in and out of the two potty waste bag ring holder parts 28 from the front side of the Potty Seat. A user needs to remove the potty waste bag holder ring 30, mount an unused potty waste bag 31, and slide the potty waste bag holder ring 30 with the potty waste bag 31 onto the two potty waste bag ring holder parts 28. Shown in FIG. 8C is a cross section of the Potty Seat with the Disposable Waste Bag attached. After each use, the potty waste bag 31 is closed immediately below the opening and the potty waste bag holder ring 30 is detached to remove the bag.

Figure 9A:
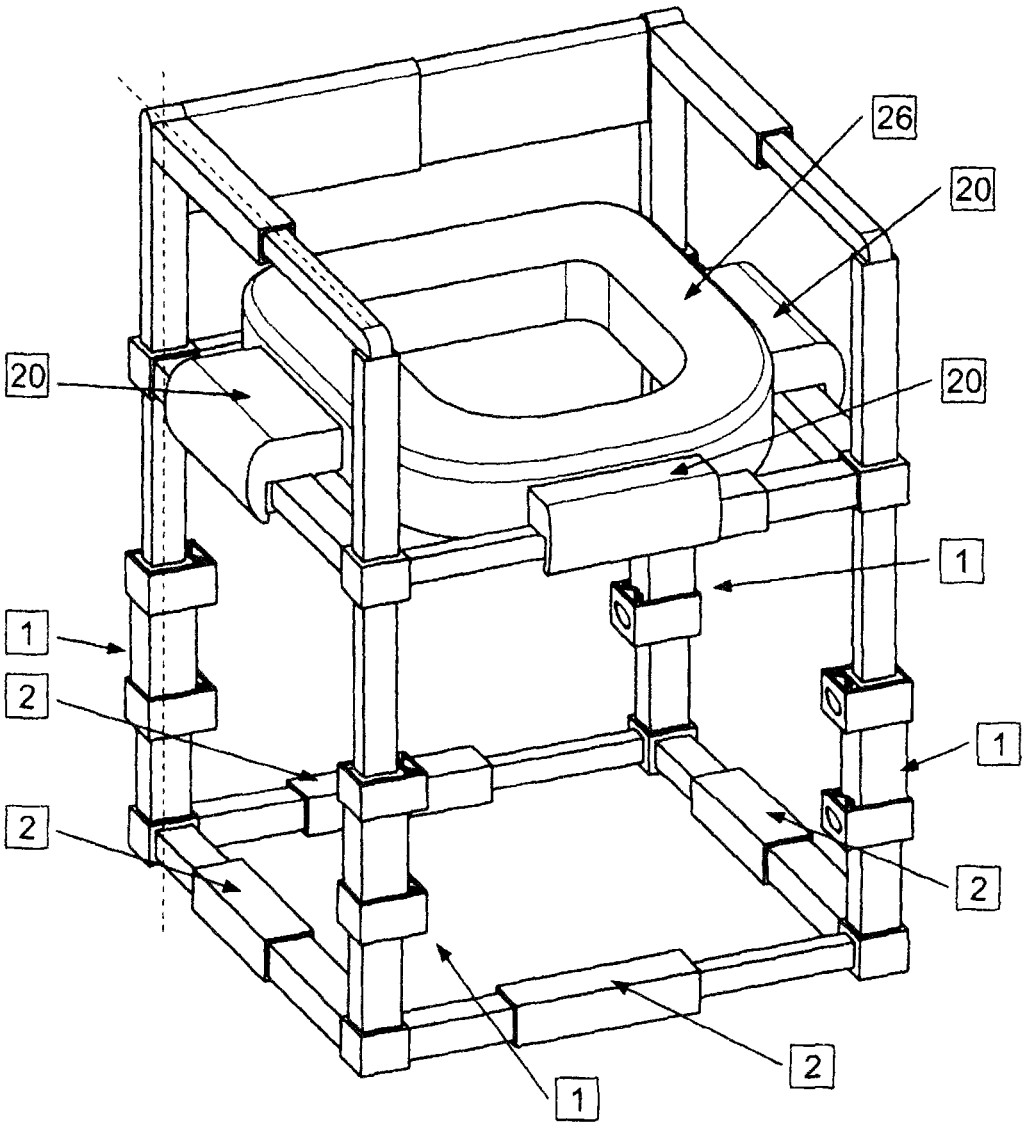
FIG. 9A shows the Adjustable Potty Chair Frame at its maximum size setting with the Back Rest and Arm Rest attachments and the Potty Seat with adjustable extensions in all sides mounted.
Figure 9B:
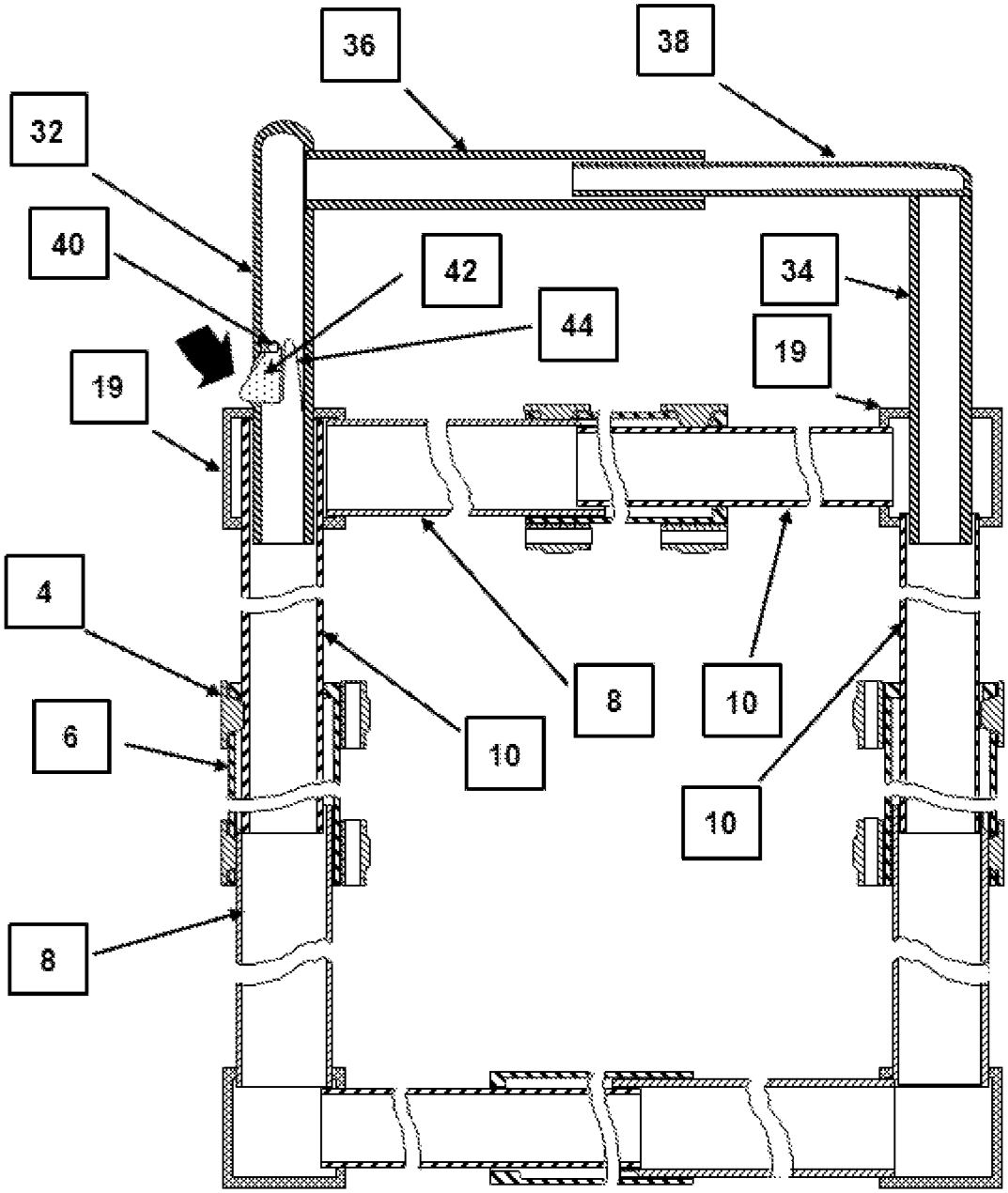
FIG. 9B shows a detailed cross section of FIG. 9A illustrating how all the parts are assembled and operated.

FIG. 9A shows the Adjustable Potty Chair Frame at its maximum size setting with the Back Rest and Arm Rest attachments and the Potty Seat with adjustable extensions in all sides mounted in a ready to be used state once the Disposable Waste Bag is attached. The adjustable extensions of the Potty Seat are extended to latch onto the Adjustable Potty Chair Frame. FIG. 9A shows arm locks 1, the bottom layer arm tubes without locks 2, base of the Potty Seat 26, and the adjustable extension 20. FIG. 9B shows a detailed cross section of FIG. 9A taken along the broken lines shown in FIG. 9A illustrating how all the parts are assembled and operated. FIG. 9B shows arm members 6, 8, and 10, independent lock components 4 and end fixtures 19 that forms the base portion of the potty frame. Vertical armrest members 32 and 34 support the horizontal members 36 and 38 that form the armrest. Vertical armrest member 32 contains an opening through which a locking component 42 can extend beyond the side of the vertical armrest members 32. Locking component 42 is pivoted using a pivot 40 that allows locking component 42 to rotate in the plan shown by FIG. 9B. The locking component 42 is also spring loaded using a spring 44 mounted on the locking component 42. When the armrest needs to be retracted, a user needs to push locking component 42 in the direction shown by the black arrow and push the armrest vertical member 32 and other armrest members 34, 36, and 38 downwards. When outer tip of the locking component 42 has reached the surface level of armrest vertical member 32, the armrest vertical member 32 can freely slide inside vertical potty frame arm member 10. This action allows the armrest to be retracted to the smallest size. When armrest needs to be used, the armrest can be pushed up using any of the armrest members 32, 34, 36, or 38 until locking component 42 emergences to lock the armrest in place above the potty frame end fixture 19. The backrest is formed by a horizontal member connecting the vertical members 32.

Figure 10A:
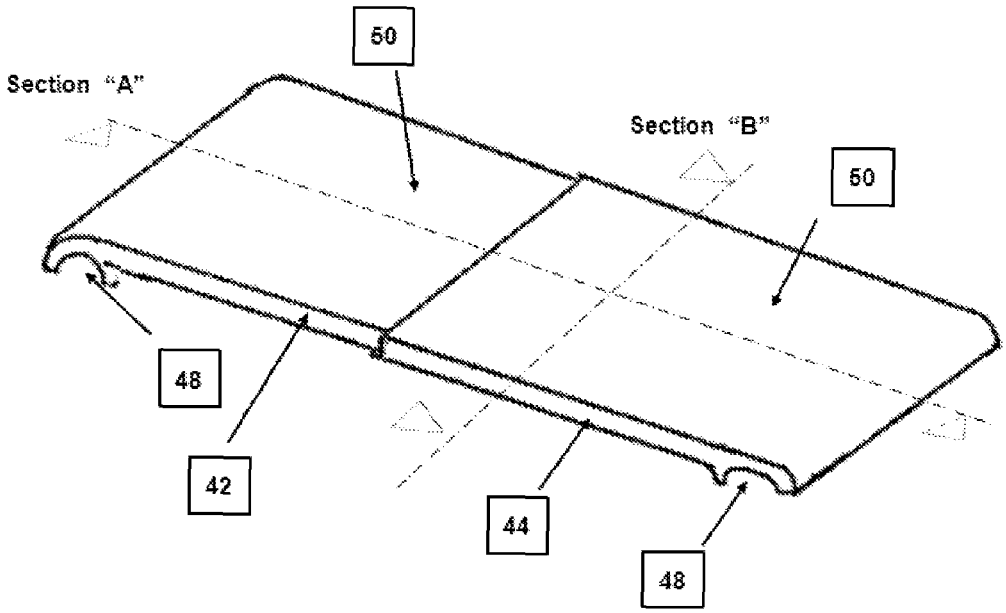
FIG. 10A shows one embodiment of the Activity Surface Attachment.
Figure 10B:
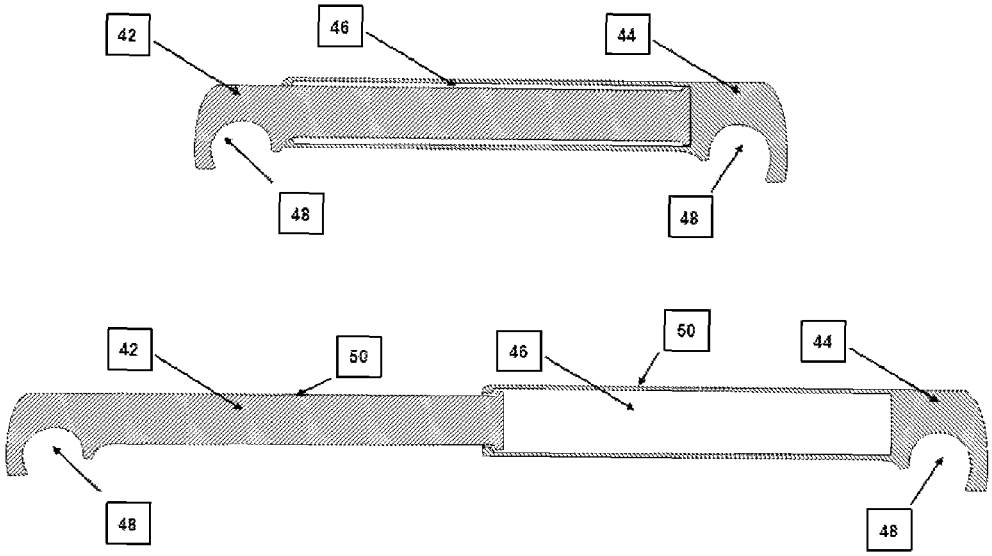
FIG. 10 B shows a cross section of the Activity Surface Attachment illustrating the method used to change the length of the Activity Surface Attachment.
FIG. 10C shows a second cross section of the Activity Surface Attachment illustrating how its cross section is designed to minimize the sagging.
FIGS. 10D and 10E shows the mechanism used to lock and unlock the Activity Surface Attachment onto the armrest.
Figure 10C:
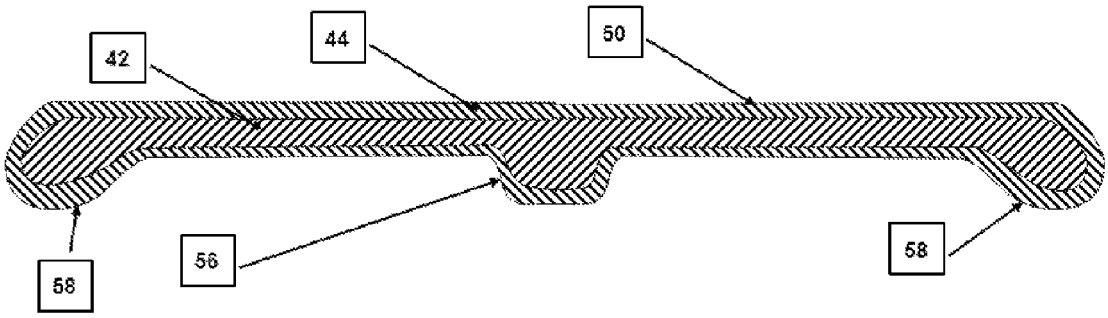
Figure 10D:
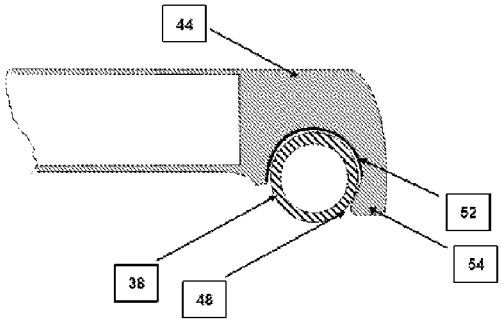
Figure 10E:
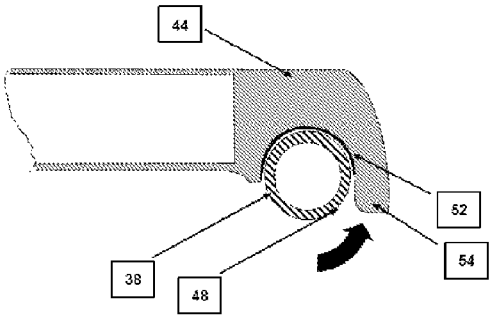

FIG. 10A shows one embodiment of the Activity Surface Attachment. Shown embodiment of the Activity Surface Attachment is designed as two parts 42 and 44. Part 42 has a thickness and width smaller than part 44 such that part 42 may be extended out or retracted in to part 44. Activity Surface Attachment also has latch parts 48 designed to latch onto the potty char arm rest. The top surfaces of parts 42 and 44, shown as 50 forms the top surface of the Activity Surface Attachment that a user may use. FIG. 10B shows a cross section of the Activity Surface Attachment along the Section "A" in FIG. 10A illustrating the method used to change the length of the Activity Surface Attachment. Activity Surface Attachment part 44 has an open space 46 within it that can accommodate the Activity Surface Attachment part 42. As shown in FIG. 10B, part 44 and part 42 can be extended out or retracted in to part 44 to change the length of the overall Activity Surface Attachment. FIG. 10C shows a second cross section of the Activity Surface Attachment along the Section "B" in FIG. 10A illustrating how its cross section is designed to minimize the sagging. Parts 42 and 44 contain three deep cross-sectional parts one 56 and two 58 that give enhanced sagging resistance to the Activity Surface Attachment. FIGS. 10D and 10E shows the mechanism used to lock and unlock the Activity Surface Attachment onto the armrest. As illustrated in FIG. 10D, latch parts 48 contain a rigid sleeve 52 that matches to the cross section of the armrest member 38 and a flexible part 54 that acts as a latching enabler. When in locked position as shown in FIG. 10D, flexible part 54 keeps the Activity Surface Attachment latched onto the armrest member 38. When unlocking as illustrated in FIG. 10E, a user needs to flex the flexible part 54 away from the armrest member 38 by applying a twisting force in the direction shown by the arrow. This enables the Activity Surface Attachment to be unlatched from the armrest member 38. The optional Activity Surface can be attached to the armrests 38 of the Adjustable Potty Chair Frame such that a child may use it as a drawing board or a support for reading or any other activity. It is noted that this surface can also be constructed as a foldable component similar to the Potty Seat construction.

Figure 11:
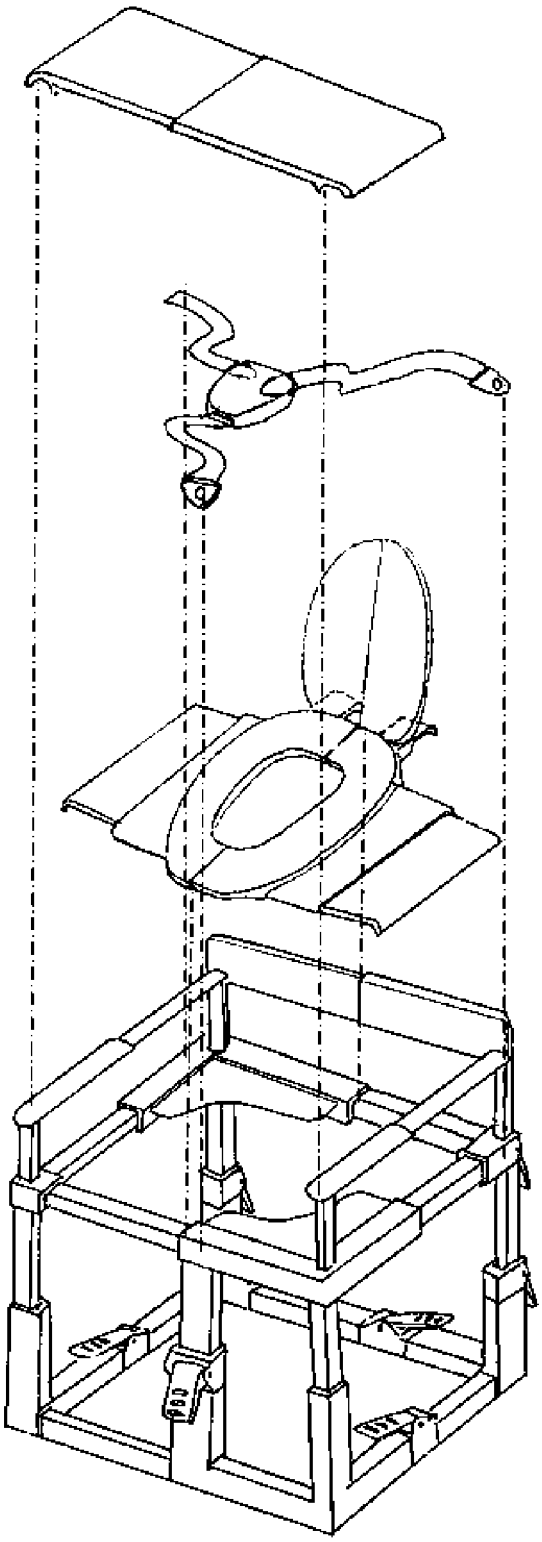
FIG. 11 shows how one embodiment of the Portable and Adjustable Potty Chair is assembled.

FIG. 11 shows how one embodiment of the Portable and Adjustable Potty Chair assembled to get the fully functional Child Potty. Note that mechanisms can be incorporated to secure the Potty Seat and the Activity Surface to the Adjustable Potty Chair Frame are not shown in the illustration in FIG. 11.

Figure 12:
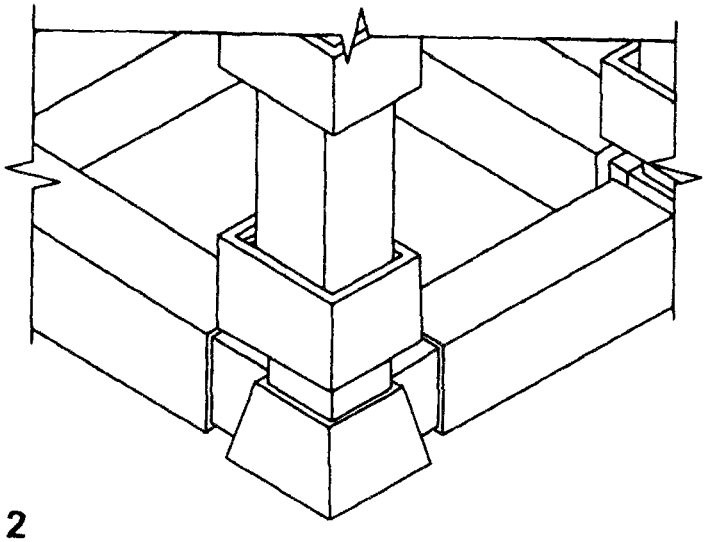
FIG. 12 shows a special modification that can be incorporated to the Adjustable Potty Chair Frame to add enhanced anti-roll capability.

FIG. 12 shows a special modification that can be incorporated to the Adjustable Potty Chair Frame to add enhanced anti-roll capability. The corners of the Adjustable Potty Chair Frame can be made with a part that extends outwards from the frame and touches the ground surface on which the device is set. The modification on the front left corner to prevent forward roll is shown in FIG. 12. It is understood that such modifications can be done to prevent forward-backward and left-right roll or any subset of this by altering the placements of the modifications. For example, by placing the modifications in the back legs only and extending outwards only (no extensions in left or right directions), backward roll resistance can be enhanced.

Figure 13:
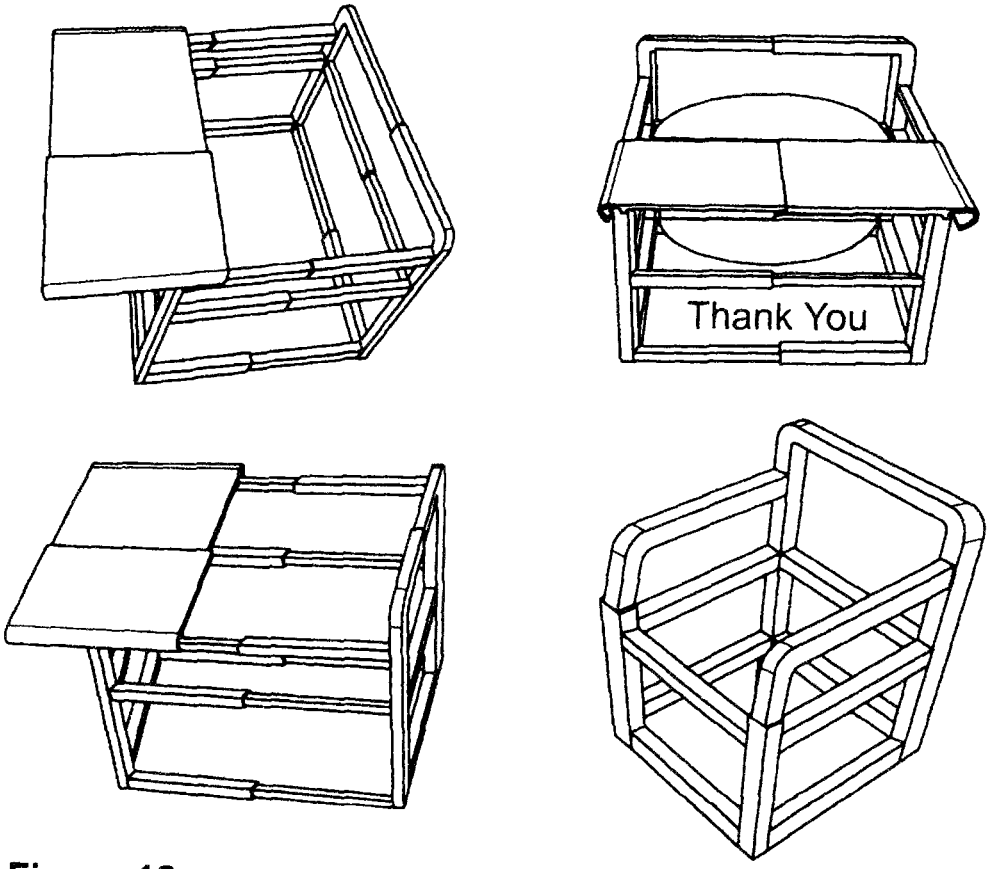
FIG. 13 are some example views of one embodiment of the device with hollow tubing of circular cross section

Shown in FIG. 13 are some example views of one embodiment of the device with hollow tubing of circular cross section. It is noted that the seat shown with this embodiment is not adjustable and not foldable compared to the other embodiments described in the document. FIG. 13 shows four different views of the device. Bottom right is the Adjustable Potty Chair Frame of the device at one H, W, and L setting. In the bottom left is the Adjustable Potty Chair Frame added with the Potty Seat and the Activity Surface Attachment. Top right shows another view of the same configuration. The top left shows the seat with a decorative covering and read to be used. This illustration is presented to show the versatility of the invented device to be manufactured in many different ways. As noted in the documents, variations shown in this document and other modifications obvious to one skilled in the art are considered within the scope of the teachings of this invention.

The invention claimed is:

1. A portable and adjustable potty comprising:

a potty frame including a plurality of arms;

a potty seat mounted onto said potty frame;

a waste bag holder, said bag holder being adapted to extend from an underside of said potty seat;

a disposable waste bag attached to said bag holder;

a fastening system attached to said potty frame to secure a potty user to said potty seat;

a back rest attachment and an arm rest attachment attached to said potty frame; and an activity surface attachment mounted onto said arm rest attachment;

wherein each of said plurality of arms comprises a first member having a first cross-section, a second member having a second cross-section and a third member having a third-cross section, wherein said first-cross section is smaller than said second cross-section and said third cross section is smaller than said first and second cross sections, wherein said first member moves at least partially within said second member to a plurality of different distinct positions, and said third member moves at least partially within said first and second members to a plurality of different distinct positions, wherein said plurality of arms are rigidly connected together to form a rectangular frame tier, said frame tier having four corners rigidly connected in a horizontal plane and four additional arms vertically spaced from and interconnected with said plurality of arms to form said potty frame.

2. The potty according to claim 1, wherein each of said arms comprises locking mechanisms that allow a user to lock a given arm at different lengths.

3. The potty according to claim 2, wherein the locking mechanisms are designed such that said potty seat does not securely fit onto the said potty frame when said locking mechanisms are not properly locked thereby readily indicating to a user that the potty is not ready to use until said locking mechanisms are properly engaged and said potty seat is secured onto the said potty frame.

4. The potty according to claim 1, wherein said additional arms include corners that touch the ground and have footings shaped such that a ground contact surface of each of said footings is larger than a frame cross section so that the footings function as anti-rolling enhancements to the said potty frame to enhance safety by introducing a roll resistance to the said potty frame on an underlying surface.

5. The potty according to claim 1, wherein said armrest attachment is extendable to support a user's arms and includes an armrest designed with smaller cross section vertical members that are pushed inside a vertical arm of said potty frame when not in use and wherein said backrest attachment includes a backrest to support the back of a user wherein the vertical members of said armrest are used to mount said backrest.

6. The potty according to claim 1, wherein the potty seat comprises adjustable extensions in one or more sides such that an overall width and length of said potty seat is adjustable using said adjustable extensions and setting said adjustable extensions at different extension settings enabling said potty seat to be mounted onto the said potty frame at different length and width settings of said adjustable extensions when pushed all the way inside results in smallest width and length dimensions of the said potty seat.

7. The potty according to claim 6, wherein the potty seat is constructed as a foldable part such that the potty seat is folded in half to minimize its storage size.

8. The potty according to claim 1, wherein said waste bag holder comprises two holder parts built into the underside of said potty seat, said two holder parts are made to receive a waste bag holder ring that holds said disposable waste bag, wherein said disposable waste bag is mounted onto said waste bag holder ring and pushed onto said two holder parts to lock said disposable waste bag.

9. The potty according to claim 1, wherein the activity surface attachment is constructed such that a length of said activity surface attachment is adjustable to match a length between said armrests of said potty frame by constructing said activity surface attachment as two parts with each part made of hollow sections of different cross section sizes so that a total length of said activity surface attachment is adjusted by one of:

retracting the smaller section of said activity surface attachment into the larger section of said activity surface attachment; or extending one section of said activity surface attachment with respect to the other section of said activity surface attachment, wherein said activity surface attachment is retracted to a length equal to half of a maximum length of said activity surface attachment plus a length of said armrest of said potty frame, wherein said activity surface attachment mounts onto said armrests of said potty frame, and wherein said activity surface attachment is designed with sagging resistance properties by means of using a cross section design which includes interlocking vertical cross sections.

10. The potty according to claim 1, wherein the disposable waste bag is biodegradable.

* * * * *